United States Patent [19]

Katagiri et al.

[11] 4,189,281

[45] Feb. 19, 1980

[54] AXIAL FLOW FAN HAVING AUXILIARY BLADES

[75] Inventors: Haruo Katagiri; Kenji Fujikake; Katsuhito Yamada, all of Nagoya, Japan

[73] Assignee: Kabushiki Kaisha Toyota Chuo Kenkyusho, Aichi, Japan

[21] Appl. No.: 862,372

[22] Filed: Dec. 20, 1977

[30] Foreign Application Priority Data

Dec. 20, 1976 [JP] Japan ..... 51-153068

[51] Int. Cl.[2] ..... F04D 29/32

[52] U.S. Cl. ..... 415/213 C; 416/236 A; 123/41.49; 165/122

[58] Field of Search ..... 416/93 R, 169 A, 236 A; 415/210, 212 R, 213 C, 119; 123/41.49; 165/122

[56] References Cited

U.S. PATENT DOCUMENTS

| | | | |
|---|---|---|---|
| 1,041,913 | 10/1912 | Tyson | 416/228 X |
| 1,834,888 | 12/1931 | Baughn | 416/236 A |
| 2,054,144 | 9/1936 | Swigert | 416/236 A |
| 3,193,185 | 7/1965 | Erwin et al. | 416/236 A |
| 3,237,614 | 3/1966 | Bentz | 123/41.49 |
| 3,635,285 | 1/1972 | Davis | 415/213 C |
| 3,677,660 | 7/1972 | Taniguchi et al. | 416/236 A |
| 3,800,866 | 4/1974 | Ireland et al. | 415/213 C |
| 3,827,482 | 8/1974 | Pope | 123/41.49 X |
| 3,937,189 | 2/1976 | Beck | 415/210 X |
| 4,061,188 | 12/1977 | Beck | 415/210 X |

FOREIGN PATENT DOCUMENTS

| | | | |
|---|---|---|---|
| 833162 | 3/1952 | Fed. Rep. of Germany | 123/41.49 |
| 2319832 | 10/1973 | Fed. Rep. of Germany | 416/236 A |

*Primary Examiner*—Everette A. Powell, Jr.

*Attorney, Agent, or Firm*—Oblon, Fisher, Spivak, McClelland & Maier

[57] ABSTRACT

An axial flow fan having auxiliary blades comprises a hub member rotatably supported and driven by a drive source, a plurality of main blades having a predetermined angle with respect to the rotational direction thereof and a predetermined width and height, the main blades being radially provided on the hub member, at least one auxiliary blade formed on at least one of a suction surface and a pressure surface of each main fan blade and having a predetermined length in the width direction of the main fan blade, a leading edge of the auxiliary blade being positioned closer to the axis of the main fan blade than a trailing edge of the auxiliary blade, a shroud comprising a thin hollow member having a large opening and a small throttled opening at opposite ends thereof, and the main fan blade being inserted within the shroud from the small throttled opening toward the large opening of the shroud. An axial inserted width L of the main fan blade, which is defined by a point of minimum opening of the small throttled opening and an inserted end portion of the inserted main fan blade in the axial direction, and an axial entire width W of the main fan blade are maintained in the following relation:

$$0 \leqq L \leqq W.$$

22 Claims, 18 Drawing Figures

AXIAL FLOW FAN HAVING AUXILIARY BLADES

BACKGROUND OF THE INVENTION

1. Field of the Invention

The present invention relates generally to an axial flow fan having auxiliary blades for use in combination with a shroud.

2. Description of the Prior Art

An ordinary type fan which is devoid of an auxiliary blade has been used in combination with a shroud for increasing the quantity of discharge air or for supplying a whole quantity of air introduced to a body to be cooled.

Meanwhile, the inventors have discovered axial flow fans having auxiliary blades (Japanese Utility Model applications Sho Nos. 50-152509, 23737, 58988, 58989, 58990), which produce strong centrifugal air streams by means of auxiliary blades. In combining an axial flow fan, according to these applications, with a shroud, the arrangement of the fan and the shroud has been studied so as to improve the quantity of discharged air and the noise level.

More particularly, the inventors have made tests and analysis for the purpose of establishing an optimum relationship or arrangement of an axial flow fan having an auxiliary blade relative to a shroud.

SUMMARY OF THE INVENTION

It is an object of the present invention, therefore, to provide an axial flow fan having auxiliary blades which establishes an optimum arrangement for a fan blade relative to a shroud.

It is an object of the present invention to provide an axial flow fan which produces both an axial flow and a radial flow.

Another object of the present invention is to provide an axial flow fan having auxiliary blades inserted within a shroud.

Still another object of the present invention is to provide an axial flow fan which prevents the air stream circulating from the pressure side towards the intake side of the fan by blocking the same by means of a shroud.

According to the present invention, there is provided an axial flow fan having auxiliary blades, comprising: two or more fan blades secured to a rotary shaft rotated by a drive means; at least one auxiliary blade being formed on at least one of a suction surface and a pressure surface of the fan blade and having a length in the chord direction of the fan blade, the end of the auxiliary blade at the leading edge of the fan blade being positioned closer to the axis of the fan than the other end of the auxiliary blade at the trailing edge of the fan blade; and a shroud having openings at the opposite ends thereof, the aforesaid openings being defined by a large diameter portion and a small diameter portion of a hollow cylindrical member, the aforesaid large and small diameter portions being positioned on the axially opposite ends of the aforesaid cylindrical member; whereby the axial, partial width L of the fan blade which covers from the minimum inner diameter of the small diameter portion of the shroud to the axial, front edge of the fan blade, which is inserted in the shroud, and the axial, entire width W of the fan blade, are maintained in the following relationship:

$$0 < L = \leqq W.$$

Meanwhile, the axial, entire width W of the fan blade is defined as a width obtained by projecting the length 'l' of the fan blade, from the leading edge to its trailing edge, onto the axis of the fan. The inserted width L of the fan blade, which is inserted into a shroud, i.e., a distance of insertion of the fan blade from the minimum inner diameter portion of the shroud toward the larger inner diameter portion of the shroud, is defined as a distance from the tip of the shroud (minimum inner diameter position) to the inserted end portion BT of the fan blade. FIG. 1 is illustrative of the aforesaid dimensions W and L of the fan, according to the invention, and should not be construed in a limitative sense.

As shown in FIG. 17, the inserted width L of the fan blade may vary in a range of 0 to 4/4W, and the fan may be applied either to a suction type or to a blow-in type fan to provide typical modifications.

In a suction type fan, the inserted width L of a fan blade B into the shroud S is defined as a distance from the tip (the minimum inner diameter position) of the shroud to the leading edge of the fan blade B, as viewed in the direction of flowing air. On the other hand, in a blow-in type fan, the inserted width L of a fan blade is defined as the distance from the tip (the minimum inner diameter) position) to the trailing edge of the fan blade B, as viewed in the direction of the flow of air.

As shown in FIG. 3, the fan according to the invention may introduce a large quantity of air from the upstream side of the air stream and then discharge the strong air comprising the ordinary axial air streams and centrifugal air streams created by the auxiliary blade AB to the downstream, while preventing a circulating air flow (reverse flow) CS from the discharge side towards the intake side of the fan.

More particularly, with the axial flow fan having auxiliary blades, centrifugal air streams created by the auxiliary blade are added to the ordinary axial air streams, so increasing the quantity of discharged air as well as a range of air to be blown, as compared with those of an axial flow fan devoid of auxiliary blades. However, there is a possibility of a circulating flow CS (FIG. 2) being created in the direction from the discharge side towards the intake side of the fan.

In addition, sidewise air streams SS are added to the intake air streams from upstream, so that the prior art axial flow fan suffers from a disadvantage of reduction in quantity of intake air from upstream of the fan in the axial direction.

In contrast thereto, according to the axial flow fan of the present invention, the shroud S is located in a proper position relative to the fan blade B, so that in the suction type fan, the circulating air streams CS from the discharge side towards the intake side of a fan may be blocked by means of the shroud S, as shown in FIG. 3(A), while the sidewise air streams SS to be joined to the air stream from upstream may also be blocked. In addition, the centrifugal air streams created by the auxiliary blades may forcibly prevent reverse air streams $CS_2$, as caused with the prior art axial flow fan with a shroud, but without an auxiliary blade, from the discharge side of a fan through a clearance between the tip of the fan blade and the shroud, to the intake side of the fan, with the result that a large quantity of air may be introduced from upstream of the fan, thereby increasing the quantity of discharged air. Furthermore, a pressure near the upstream side of the fan may be lowered by the provision of the shroud, so that the quantity of air to be introduced may be increased. On the other hand, in the blow-in type fan according to the invention, as shown in FIG. 3(B), the centrifugal air streams from the fan B and shroud S may block the circulating air streams CS from the discharge side towards the intake side of a fan, so that the whole quantity of discharged air from the fan may be directed downstream through the shroud S.

In case a pressure resistance, such as heat exchanger and a filter is present upstream of the shroud, i.e., at the large diameter position of the shroud in a suction type fan, a chamber is defined in surrounded relation by the aforesaid pressure resistance, shroud and fan, so that circulating air streams CS from the discharge side towards the intake side of a fan, as well as air streams SS from the side portion in the upstream of the fan may be blocked, while centrifugal air streams created by the auxiliary blade in the present invention may prevent strong reverse air streams having the velocity component in the opposite direction from the discharge side of a fan through a clearance between the tip of the fan and the shroud to the discharge side of the fan, with the result that an almost vacuum state is created in the aforesaid chamber, and hence a large pressure gradient is created between the chamber and the atmosphere in the upstream of pressure resistances, such as a heat exchanger and filter. As a result, a large quantity of air may be introduced through pressure resistances, thus providing the improvement on heat exchange. In addition, there is created a large pressure difference between the downstream and upstream sides of a fan, so that a large quantity of air may be discharged at a high efficiency. In this respect, in case there is a large-size pressure resistance such as an engine in a cooling fan of an automobile, the fan according to the invention finds its best application. In other words, with a prior art axial flow fan devoid of an auxiliary blade, the air blowing efficiency is lowered in case a large-size pressure resistance (engine) is present on the discharge side of a fan. In contrast thereto, according to the fan of the invention, strong centrifugal air streams may be created by means of an auxiliary blade AB, so that there are created air streams flowing along the wall of a pressure resistance (engine). As a result, a large quantity of air may be introduced, past a radiator (heat exchanger), due to the aforesaid large pressure gradient between the upstream and downstream sides of a fan, without lowering air-blowing efficiency, and yet a large quantity of air may be discharged into an engine room. As a result, the axial flow fan according to the present invention may allow a radiator to perform its heat exchange function effectively, and produce strong air streams within an engine room, thereby preventing dwelling of heat caused by an exhaust device, lowering the temperature of an engine room, and eliminating an improper operation of a carburetor and troubles in exhaust devices.

In case the axial flow fan according to the present invention is applied to a blow-in type fan, where a pressure resistance producing heat, such as a heat exchanger, filter and the like, is present downstream, i.e., at the large diameter position of the shroud S, then a chamber is defined in surrounding relation by a fan, shroud, and pressure resistance, while circulating air streams from the discharge side towards the intake side of the fan are blocked by the shroud and the centrifugal air streams of the fan according to the invention, thus increasing the pressure in the aforesaid chamber. As a result, all of the discharged air may be passed through a heat exchanger or filter, thus allowing the heat exchanger to perform its function effectively. In addition, in case the shroud is so shaped as to follow the centrifugal air streams created by the auxiliary blades in the fan according to the invention, then air may be blown over a wide range, unlike the prior art axial flow fan, wherein discharged air streams are throttled at the discharge end of a fan. Accordingly, a small sized fan may well accommodate itself to the cooling of a large sized pressure resistance, such as a heat exchanger.

As far as the fan having auxiliary blades according to the invention is used, it is essential to provide a shroud for preventing circulating air streams. In addition, proper positional arrangement of a shroud relative to a fan is essential for permitting smooth creation of centrifugal air streams.

BRIEF DESCRIPTION OF THE DRAWINGS

Various other objects, features and attendant advantages of the present invention will be more fully appreciated as the same becomes better understood from the following detailed description when considered in connection with the accompanying drawings wherein like reference numerals designate like or corresponding parts throughout the several views, and wherein.

DETAILED DESCRIPTION OF THE ILLUSTRATED EMBODIMENTS

Figure 17:
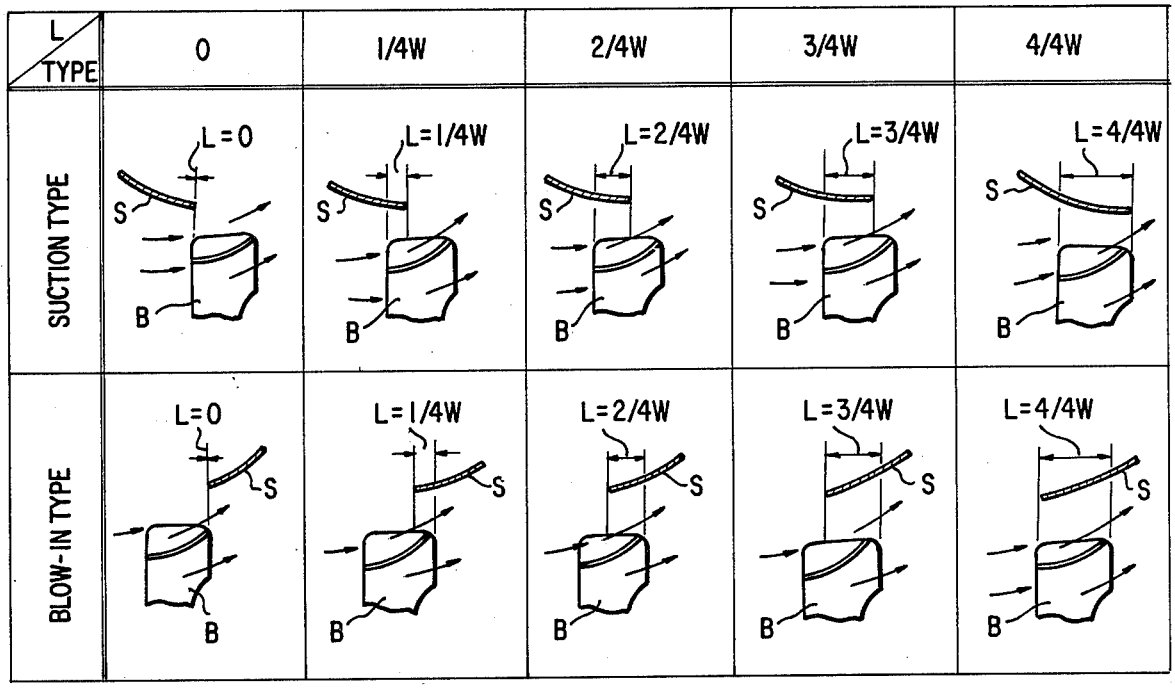
FIG. 17 illustrates typical modifications of the present invention in which the inserted width of the fan blade is varied in a range of 0 to 4/4W.
Figure 1:
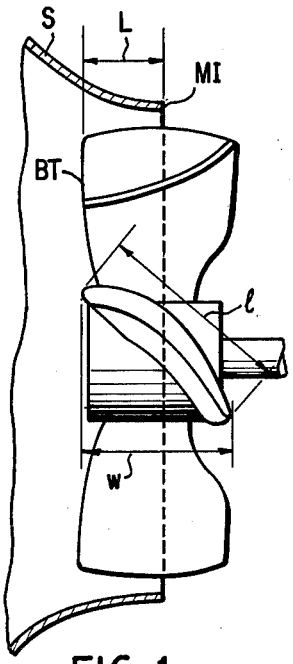
FIGS. 1 to 3A–B are views illustrative of the embodiments of the present invention.
Figure 2:
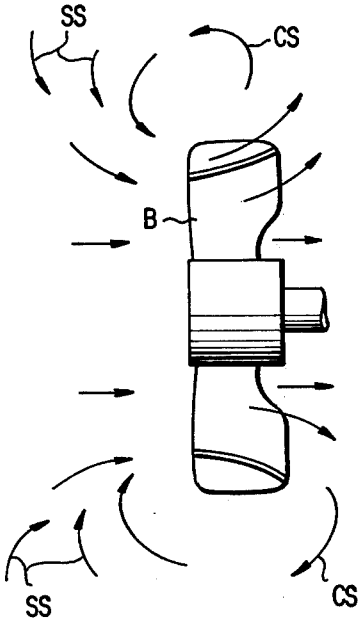
Figure 3A:
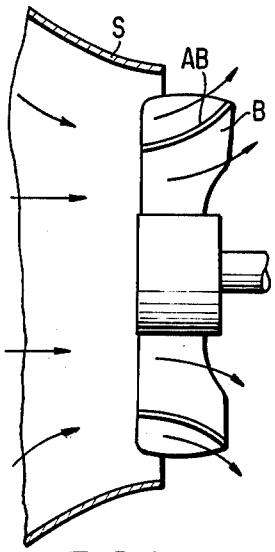
Figure 3B:
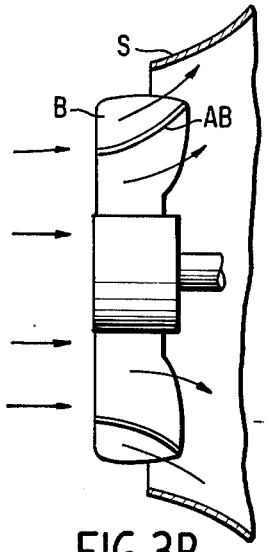
Figure 4:
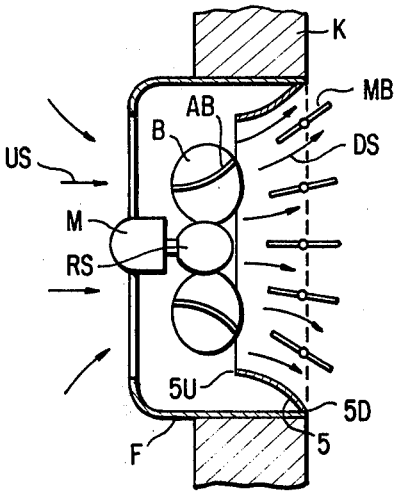
FIG. 4 is a view illustrative of a first embodiment of the invention.

The axial flow fan according to the invention will now be described by way of specific embodiments. The first embodiment which is applied to ventilation equipment will be described in more detail with reference to FIG. 4.

According to the first embodiment, there is provided an axial flow fan which includes four circular blades B secured, in the radial direction, to a spherical rotary shaft RS, driven by an electric motor M, with a suction surface of the circular blade B being formed with an auxiliary blade AB. The leading end of the auxiliary blade AB is positioned at a radially mid point of the blade B, while the trailing end of the auxiliary blade is positioned at a radially 3/4 point of the blade B, with an arcuate surface being provided between the leading end and the trailing end of the auxiliary blade AB. The shroud 5 is formed into a smooth arcuate cross section which follows the centrifugal air streams created by the auxiliary blade, while a tip portion 5U of the shroud 5 at the small diameter position thereof is positioned in the axial trailing end of the blade B, and a diametrically large trailing end 5D of the shroud 5 is coupled to a frame F which is connected to an electric motor M through the medium of four leg portions of a small diameter. Strip members MB are rotatably and cooperatively provided at the rear end of the shroud 5, so as to close an opening of the shroud, when the fan is not in use, and set in a condition shown in FIG. 4, when in use. The fan in this embodiment is provided on a boundary between a wall K, or a window, and the exterior of a room.

When the electric motor M is turned on and the member MB is manipulated, as shown, then the axial flow fan according to the first embodiment may draw polluted air, smoke and odor from a room, as air streams US, thereby discharging the air as discharged air streams DS.

In this embodiment, the front end 5U (minimum inner diameter position) of the shroud 5 is aligned with the axial trailing edge of a fan blade, (inserted length L=0), so that circulating air streams from the discharge side towards the intake side of the fan may be blocked and hence the quantity of discharged air may be increased. Thus, air may be introduced into the fan and discharged therefrom effectively. In this embodiment, the auxiliary blade AB is formed on the blade B, so that strong centrifugal air streams are formed over a wide range. (The contour of the shroud 5 is shaped in line with air streams in this embodiment). This enables an area of an opening at the discharge end of the fan to be enlarged, thereby reducing the aerodynamic resistance of air streams flowing therethrough, so that air may be effectively discharged from a room at a high ventilating efficiency.

Figure 5:
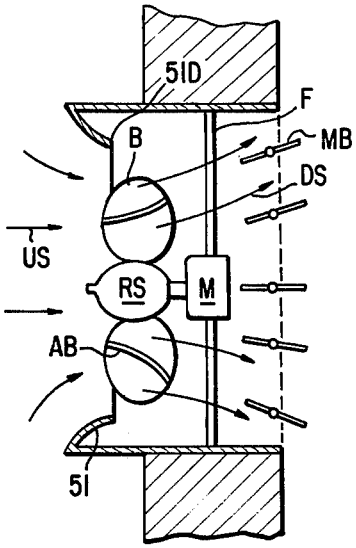
FIG. 5 is a view illustrative of a modification of the first embodiment.

FIG. 5 shows a modification of the first embodiment. The difference between the two will be described hereunder with specific reference made to FIG. 5.

The fan according to the first embodiment of the invention is used in a blow-in mode, while the fan according to this modification is used in a suction mode. In this modification, a shroud 51 of an arcuate cross section is positioned on the intake side of a fan, and an electric motor M is positioned downstream of a rotary shaft RS and supported by a frame F, the fan thus being driven rearwards. In this case, the downstream end 51D of the shroud 51 (minimum inner diameter position) is aligned with the leading edge of the blade B. In other words, the inserted length L of the fan into the shroud 51 is zero. The other arrangements are the same as that of the first embodiment.

The fan, according to this modification, may draw polluted air, smoke and odor from a room as air streams US and discharge the same as air streams DS.

According to this modification, the shroud 51 is positioned on the intake side of a fan, so that acirculating air streams from the discharge side of a fan towards the intake side of a fan may be intercepted and centrifugal air streams created by the auxiliary blade may accompany a reverse air stream tending to flow in the opposite direction between the shroud and the fan, and flow towards the discharge side of a fan. Accordingly, there may be achieved strong air streams from upstream due to the prevention of a reverse flow of air, thereby drawing air from a room for discharge of the same to the exterior.

In addition, the provision of the shroud 51 on the intake side of a fan creates an almost vacuum state upstream of the fan, so that the fan may strongly draw air out of a room.

The description will now be turned to the second embodiment of the invention.

Figure 6:
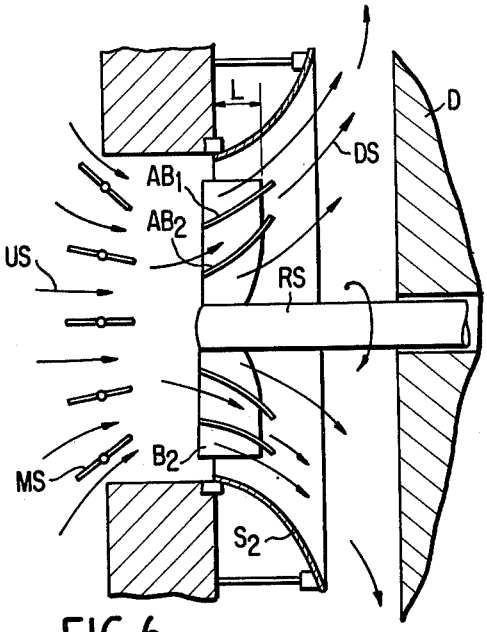
FIG. 6 is a view illustrative of a second embodiment of the invention.

As shown in FIG. 6, an axial flow fan according to the second embodiment is applied to a blower in a plant, which draws air from outside into the plant and then towards a device D generating heat therein for cooling the device D.

With the axial flow fan according to the second embodiment, four fan blades B2 are secured radially to the rotary shaft RS, driven by a suitable drive means. Two auxiliary blades AB1, AB2 are formed on the suction surface $I_2$ of each fan blade B2, wherein the spacing between the auxiliary blades AB1, AB2 at the leading ends of the blades is larger than the spacing at one of the trailing ends of the blades (a non-equal spacing relation) and, in addition, the leading ends of the auxiliary blades AB1, AB2 are positioned closer to the center of rotation of the fan than the trailing ends thereof, while smooth curved surfaces are defined therebetween. Yet furthermore, the auxiliary blades extend beyond the trailing edge of the fan blade B into a wake region aslant a distance corresponding to 0.2 times (0.14 mm) the chord length I (70 mm) of the fan blade B, as viewed radially outwards.

The front end (a minimum inner diameter position) of the shroud S2, as viewed in the direction of the air streams, is attached to the wall of a building of a plant, while the rear end of the shroud S2 is attached through the medium of a supporting frame F to the wall of a building, so that the shroud S2 may be secured to the wall of the heat generating device D in a given position. In this respect, the fan blades B2 are inserted into the shroud S2 a distance 3/4 of the axial width W of the fan blade, i.e., a distance from the minimum inner diameter position of the shroud S2 to the axial trailing edge of the fan blade B2, L=3/4W. As in the preceding embodiment, strip members MB are rotatably mounted in an opening in the wall of a building, so that the members MB are set in the condition shown, when in use, and close the opening, when not used.

With the axial flow fan according to the second embodiment, when the rotary shaft RS is rotated in the direction indicated by an arrow, as shown, then the fan draws cool air from outdoors through the members W, as air streams US, an then discharges the same as air streams DS towards the device D for cooling.

According to the second embodiment, the fan blade B2 is inserted into the shroud S2 a distance L=3/4W, with the result that even if air aerodynamic resistance, such as a body D to be cooled, is large, and the fan is subjected to the influence of a back pressure, circulating air streams (reverse air flow) from the discharge side towards the intake side of the fan may be blocked by the shroud S2 as well as by centrifugal air streams created by the auxiliary blades, so that the whole quantity of air discharged from the fan may be directed to the device D for effectively cooling the same.

In addition, according to the second embodiment of the invention, centrifugal air streams having a high peripheral speed are created by the auxiliary blades extending beyond the trailing edge of the fan blade, so that strong centrifugal air streams are created over a radially wide range, and, in addition, the contour of the shroud S2 is spread or diverged in line with the air streams. Accordingly, the axial flow fan of this embodiment may supply air over the entire range of the large sized device D.

Yet furthermore, the contour of the shroud S2 is shaped in line with the centrifugal air streams from the fan, thereby causing no turbulence thereon, and allowing smooth air flow around the device D. In addition, the noise level, the importance of which has come to the fore recently, may be reduced by the fan according to this embodiment.

The third embodiment is applied to a cooling system, as a radiator fan, in an automobile.

Before going further into the description of the third embodiment, the cooling system of an automobile will be described briefly.

Figure 7:
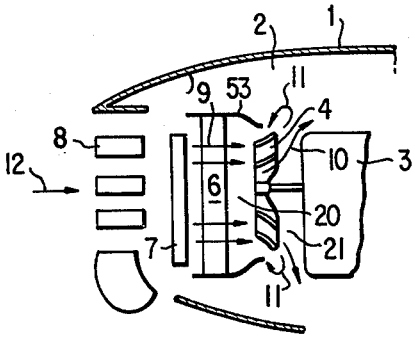
FIGS. 7 to 9 are views illustrative of a third embodiment of the invention.

FIG. 7 shows the general layout of a cooling system 2 of an automobile disposed in a bonnet 1 of an automobile and including an engine block 3 and other accessories on the discharge side 21 of a fan 4, a radiator 6, condensor 7, grill 8 and shroud 53 which is provided for the radiator 6 and covers the fan 4 on the intake side 20 of the fan 4. In this system 2, a pressure resistance, such as engine block 3, is present on the discharge side 21 of the fan 4, while the shroud 53 surrounds large pressure resistances such as the radiator 6 and the condensor 7 on the intake side 20 of the fan.

Accordingly, upon rotation of the fan 4, a large pressure difference is formed between the discharge side 21 and the intake side 20 of the fan, and air 9 passing through the radiator 6 is deflected outwards by the fan 4, where a low pressure resistance prevails, thereby providing discharge air stream 10. Furthermore, due to the aforesaid pressure difference, there is created a reverse flow 11 passing through a clearance defined between the fan 4 and the shroud 53, so that only part of the discharge air may pass through the radiator, thus lowering the cooling and air-blowing, or drawing efficiency, a large extent.

To prevent the aforesaid reverse flow 11, one approach is to reduce the clearance. However, this attempt is not adopted due to the relative vibrations of the fan and the shroud. On the other hand, in case the clearance is increased, then an aerodynamic resistance of ram air may be reduced, thus allowing full utilization of ram air when an automobile runs at a high speed and providing improved productivity. For this reason, the clearance on one side is set to be over 20 mm.

Accordingly, for increasing the cooling and air-blowing efficiency, the best approach is to prevent the reverse flow of air by the fan itself, because of the freedom from the problems of ram air and productivity.

In addition, the provision of the shroud 53 leads to a lowered pressure in an intake side chamber 20 in the fan, thereby increasing the difference in pressure between the inlet and outlet of the condensor 7 and the radiator 6, thus aiding in the smooth flow of air 9. This is essential for improving the cooling and air-blowing efficiency of the fan. For the use of a fan in combination with a shroud, it is desirable to provide a fan which accommodates itself to air streams for improving the efficiency thereof. To this end, the fan having an auxiliary blade, which is of an axial flow type and provides centrifugal air streams, is best suited, because the discharge air 10 from such a fan flows outwards in the case of a cooling system 2 having a large pressure difference, and, in addition, streams along a blade surface are subjected to the aforesaid pressure difference so that the fan produces three dimensional air streams consisting of axial air streams and centrifugal air streams.

The improvements in the quantity of discharge air and efficiency may be attained by selecting the fan which produces air streams following an intended stream line, as well as by selecting an optimum position of the shroud surrounding the fan. In addition, a cooling-air-blowing device which may reduce the level of noise can be provided.

Figure 8:
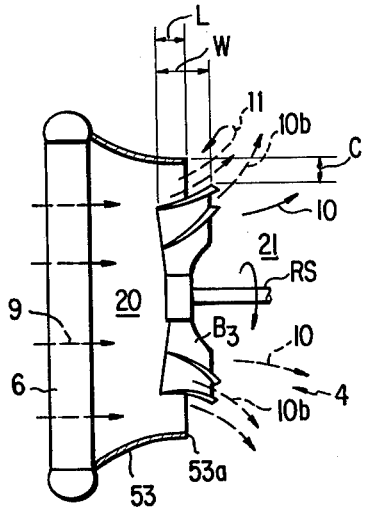
Figure 9:
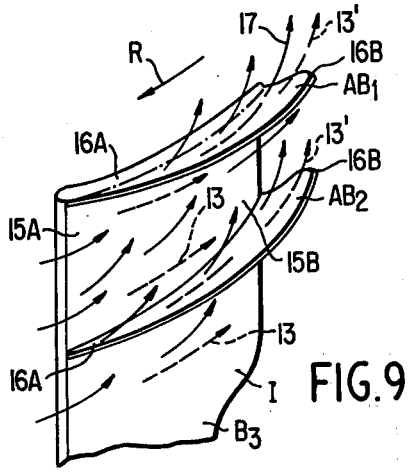

According to the axial flow fan of the third embodiment, as shown in FIGS. 8 and 9, two auxiliary blades AB1, AB2 are formed on each suction surface I of the fan blades B3 secured to a rotary shaft RS which is rotated and driven by an engine. In this respect, the auxiliary blades AB1, AB2 are spaced from each other at a suitable spacing along the air streams 13 flowing along the surface I of the fan blade, with the leading ends 16A of the auxiliary blades AB1, AB2 being positioned closer to the center of rotation of the fan than the trailing ends 16B of the auxiliary blades AB1, AB2. In addition, the auxiliary blades are curved outwards of the fan blade B3 at a suitable curvature. The widths of the auxiliary blades AB1, AB2 are gradually increased from the leading ends 16A towards the trailing ends thereof, this width being referred to as the height of the auxiliary blade, as well, with the width of the auxiliary blades being maximized at the trailing ends 15B of the blades. This width is 13 mm. In addition, the auxiliary blades are inclined gradually from the leading ends 16A towards the trailing ends 16B in the radially outward direction of the blades, with an inclination of the auxiliary blades peaking at the trailing ends 15B of the auxiliary blades. The maximum inclined angle thereof is 20° with respect to the vertical plate of a fan blade. Furthermore, the spacing between the auxiliary blades AB1, AB2 at the leading edge 15A of the fan blade is larger than that at the trailing edge 15B thereof (non-equal spacing relation), while one (AB1) of the auxiliary blades AB1, AB2 is positioned at the radially outermost position of the fan blade. A shroud 53 covering the fan 4 is secured by suitable fastening means, not shown, to flange portions positioned on the opposite sides of the radiator 6. A wall **53*a* of the shroud 53** on the side of the fan is of a hollow cylindrical construction having a linear peripheral portion.

The minimum clearance C between the tip of the fan and the shroud is 20 mm. In this case, W represents the axial width of a fan blade at the radially outermost portion thereof, and L represents a distance between the front end of the fan blade and the end surface **53*a*** of the shroud on the side of a fan. Thus, $L/W=\epsilon$ is defined as a covering rate of the shroud relative to the fan. In this embodiment, $\epsilon=1/2$.

Meanwhile, in case the distances between the inner surfaces of the walls of the shroud in cross-section is constant, as in the fan-side end surface **53*a* of the shroud 53**, the minimum inner diameter is defined as the diameter of the shroud at its trailing end, as viewed in the direction of the air streams.

When the fan according to this embodiment is rotated in a direction indicated by arrow R, then blade air streams 13 are created on the suction surface I of the fan, flowing along the blade surface, and air streams 13' along the surface of the auxiliary blade in a range from the leading end 15A to the trailing end 15B of the fan blade. Since the auxiliary blades AB1, AB2 are curved slowly in an arcuate form with respect to the rotational direction thereof and inclined radially outwards, so that centrifugal air streams 17 may be created, which are stronger than those in the first and second embodiments, strong air streams 10*b* are discharged aslant and outwards from the trailing end 15B of the blade.

On the other hand, there are created such axial air streams as obtained in a prior art axial flow fan, and air streams directed slightly aslant, so that air 10, including centrifugal air streams 17, may be strongly discharged both in the axial and centrifugal directions, so that the quantity of air passing through the radiator 9 is increased, with an accompanying increase in cooling efficiency.

In this case, particularly strong centrifugal air streams 17 are created at the trailing end 15B of the fan blade. The centrifugal air streams thus created at the trailing end of the blade should not be hindered.

According to a prior art axial flow fan devoid of auxiliary blades on the surface of the primary blade, if air streams are introduced in only the axial direction, then there results an increase in fan efficiency. When the covering rate of the shroud relative to the fan is no less than $1(\epsilon \geqq 1)$, and the fan is covered with the shroud, then strong axial air streams 10*a* may be obtained.

In contrast thereto, according to the fan of the invention, there may be created air streams 10, including the axial flow and centrifugal air streams, and the centrifugal air streams may be discharged particularly strongly from the trailing end of the blade, the covering rate $\epsilon$ of the shroud is set to $1/2(L=1/2W)$.

The leading edges 15*a* of the fan blades B3 are covered with the shroud 53, thereby facilitating and arranging the axial flow of air in order, with the trailing edges of the fan blades B3 being exposed from the shroud 53, in an attempt that centrifugal air streams are not hindered by the shroud to use positively the centrifugal air streams. As a result, there may be achieved air streams 10 including centrifugal air streams, thereby increasing the air-blowing efficiency of the fan, with the resulting increase in quantity of discharge air 9 passing through the radiator 6.

Due to a difference between the pressure in an intake chamber 20 defined by the radiator 6, shroud 53 and fan 4, and a discharge chamber 21 defined by the fan 4 and engine 3, a reverse flow (circulating flow) tends to be created in a range from the discharge chamber 21 to the intake chamber 21 for the fan. However, the aforesaid reverse flow may be blocked by the shroud 53, while a reverse flow 11 produced in a clearance C between the fan 4 and the shroud 53 is blocked by the centrifugal air streams 10*b*. In other words, the centrifugal air streams close the clearance as an air curtain, so that the reverse flow 11 may be completely prevented, thereby allowing the maximum quantity of discharge air 10 to pass through the radiator for improving the cooling efficiency thereof.

The prevention of a reverse flow is carried out by resorting to air streams created due to a difference in pressure between the intake side 20 and the discharge side 21 of the fan. Accordingly, the fan 4 and shroud 53 are not pressure resistances for ram air 12 coming from the front of the radiator in an automobile.

In addition, the covering rate $\epsilon$ of the shroud relative to the fan is set to about $1/2(\epsilon=1/2)$, so that centrifugal air streams will not cause impingement, vibrations and resonance within the shroud, and may reduce the noise level.

According to the third embodiment of the invention, the covering percentage of the shroud relative to the fan is set at about 1/2, so that the quantity of discharge air from the fan in the cooling system of an automobile, which is required for cooling the radiator and the like, may be maximized, and the noise level attained may be kept at its lowest. In addition, according to the third embodiment, the whole quantity of air drawn through the radiator 6 may be discharged from the fan 4, so that there may be obtained ample air streams within an engine room 2, and the dwelling of heat due to an exhaust device may be prevented, and problems of improper operation of a carburetor and troubles in the exhaust device may be solved.

Figure 10:
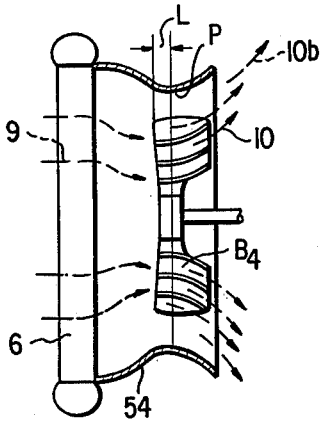
FIG. 10 is a view illustrative of a fourth embodiment of the invention.

The fourth embodiment is applied to a cooling system in an automobile, as in the third embodiment. The difference between the two will be described with reference to FIG. 10.

According to the fan of the fourth embodiment, as in the third, three auxiliary blades are formed in equal spacing on the suction surface of the fan blade. One end of a shroud 54 is secured to a radiator positioned on the intake side of the fan, while the other end thereof covers the fan. The inner diameters of the shroud are gradually reduced up to the position of the minimum inner diameter thereof, and then increased gradually in the downstream part from the position of the minimum inner diameter thereof, forming a horn shape.

The fan according to the fourth embodiment, as in the third, produces mixed air streams 10, including axial air streams and centrifugal air streams, and discharges the same towards the discharge side. The discharge air streams 10 serve as cooling air streams 9 passing through a radiator on the intake side thereof. The quantity of cooling air 9 is increased because of the mixed air, including the centrifugal air streams added to the axial air streams.

In this case, as well, the centrifugal air streams are particularly stronger at the trailing edge of the fan blade. Because the air-blowing region is expanded, the shroud is diverged at the downstream end so as not to hinder the strong air streams, thereby arranging the centrifugal air streams in order and reducing the loss incurred when converting the velocity energy of the centrifugal air streams into a pressure energy, according to the diffuser effect, and improving the air-blowing efficiency.

An inserted width of the fan, relative to the shroud, is defined as a distance L between a point P where the maximum speed of the air may be obtained, i.e., the minimum diameter position of the shroud, and the leading edges of the blade.

The reason why shroud 54 is formed into the aforesaid shape is to restore gently the pressure to minimize a loss of pressure.

In this embodiment, the inserted length L is set to 2/5W. The leading edge portion of the blade guides the inflowing air streams in the axial direction, and arranges the same in order, while the trailing edge of the blade contributes to the creation of centrifugal air streams 10*b* and recovery of pressure.

This embodiment provides advantages in that the air-blowing and cooling efficiencies are improved by minimizing the loss of discharge air 10 from the fan and increasing the quantity of air 9 passing through the radiator, while loss, impact noise and resonance of air are reduced, with a resulting reduction in noise level, by preventing a reverse flow 11 while permitting smooth flow of the centrifugal air streams, thereby increasing the quantity of cool air to pass through the radiator.

The fourth embodiment also provides other functions and advantages, as does the third embodiment, besides the above.

The axial flow fan according to the fifth embodiment of the invention is applied to a cooling fan used in a fork lift equipped with lift means for packages in the front portion of a vehicle. The difference between the fifth embodiment and the preceding embodiments will be described in detail with reference to FIG. 11.

The cooling system in a fork lift produces a large amount of heat, as compared with those in automobiles according to the third and fourth embodiments, so that the capacity of radiator 9 is large. Because the thickness of the radiator 9 is large, the resistance against air flowing is large. In addition, a discharge port 18 for air is commonly used as a weight for the fork lift, so that the size of the air port is small, and the pressure loss on the discharge side of the fan is extremely large.

With the prior axial flow fan devoid of an auxiliary blade, a pressure rise takes place on the discharge side 21 of a fan due to rotation of the fan. However, a large pressure loss is incurred at the aforesaid discharge port in the direction of the air streams from a discharge chamber 21, so that a reverse flow occurs from the discharge chamber 21, through a clearance between the fan and the shroud, towards the intake side 20 of the fan, so that poor cooling efficiency for radiator 9 results.

Figure 11:
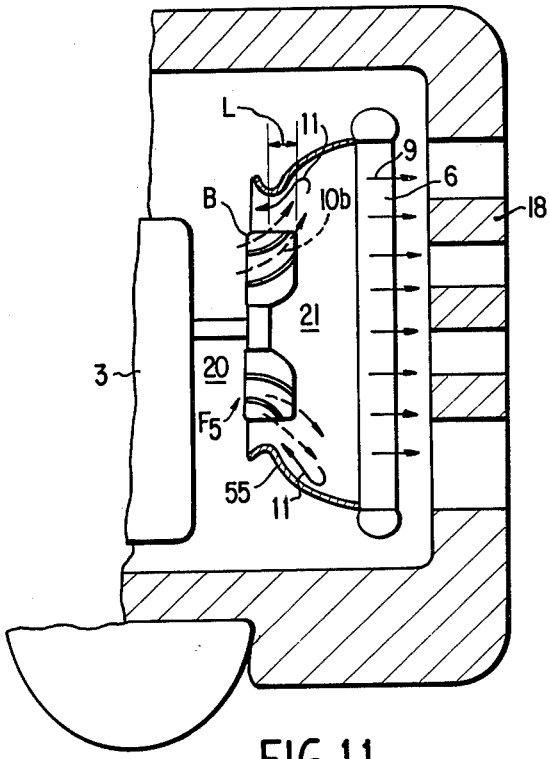
FIG. 11 is a view illustrative of a fifth embodiment of the invention.

As shown in FIG. 11, the fifth embodiment of the invention is applied to a fork lift having a lifting means in the front portion of a vehicle. In this fork lift, an engine is located under an operator's seat, so that a shroud 55 and radiator 6 are located on the discharge side 21 of the axial flow fan. One end of the shroud is secured to the radiator, while the other end of the shroud covers the fan, thereby facilitating the smooth flow of discharge air from the fan through the radiator. The fan in this case is used in a blow-in mode, unlike the third and fourth embodiments.

With the fan in this embodiment, two auxiliary blades are formed on the surface of a fan blade, whose construction, functions and advantages remain the same as those in the preceding embodiments.

The shroud on the discharge side of the fan is diverging and is bolted to the radiator having a height and width of 1.5 times as large as the diameter of the fan. In this embodiment, a distance L of the fan F5 between the minimum inner diameter position of the shroud 55 and the trailing edge of the fan blade (an inserted width of the fan relative to the shroud) is set at 3/4W.

As in the preceding embodiment, air streams created, due to the rotation of a fan, are provided in the form of mixed air streams 10 consisting of axial air streams and centrifugal air streams, and particularly strong centrifugal air streams **10*b*** are discharged from the trailing edge of the blade.

In this embodiment, an axial flow fan which produces centrifugal air streams is used, and the shroud has a diverging wall, so as not to hinder the centrifugal air streams, so that the quantity of discharge air 10 may be increased to 1.5 times as much as the quantity of air given by the prior art fan, because of the addition of centrifugal air streams. In addition, because of a diverging portion of the shroud, air may be introduced smoothly and its velocity energy may be converted into pressure energy without loss, so that the quantity of air 9 being introduced into the radiator may be further increased, with an accompanying increase in cooling capability. The fan provides both axial air streams and centrifugal air streams, so that the air-blowing and cooling range may be enlarged 1.5 times, and cooling air may be delivered over the entire surface of the radiator 9, at an increased cooling efficiency and a low noise level.

In addition, the aforesaid reverse flow 11, as is experienced with a prior art fan, may be prevented by the centrifugal air streams **10*b* and shroud 55 for utilizing the whole quantity of air 10** created by the fan for cooling the radiator.

The shroud 55 is diverged at one end, so that an obstacle for centrifugal air streams, impact sound and swirl of air may be eliminated, thereby lowering the noise level.

In this embodiment, the position of the minimum inner diameter of the shroud is of importance for maximizing the velocity energy, and thus $L=3/4W$. In addition, the shroud is so diverged that the leading edge of the blade may contribute to reduction in loss of air introduced in the axial direction, while the trailing edge of the blade may contribute to allow the smooth flow of the centrifugal air streams.

In the fifth embodiment, as shown in FIG. 11, air is introduced through an annular opening defined between the engine 3 and the fan F4 during the rotation of the fan, and then axial air streams and centrifugal air streams are created by the auxiliary blades, and then the mixed air streams thus created are delivered to a radiator of a cross-sectional area of about 2.5 times as large as a projected area of the rotating fan, thereby cooling the engine-cooling water effectively.

The fan according to the fifth embodiment also provides other functions and advantages similar to those obtained in the preceding embodiments.

Figure 12:
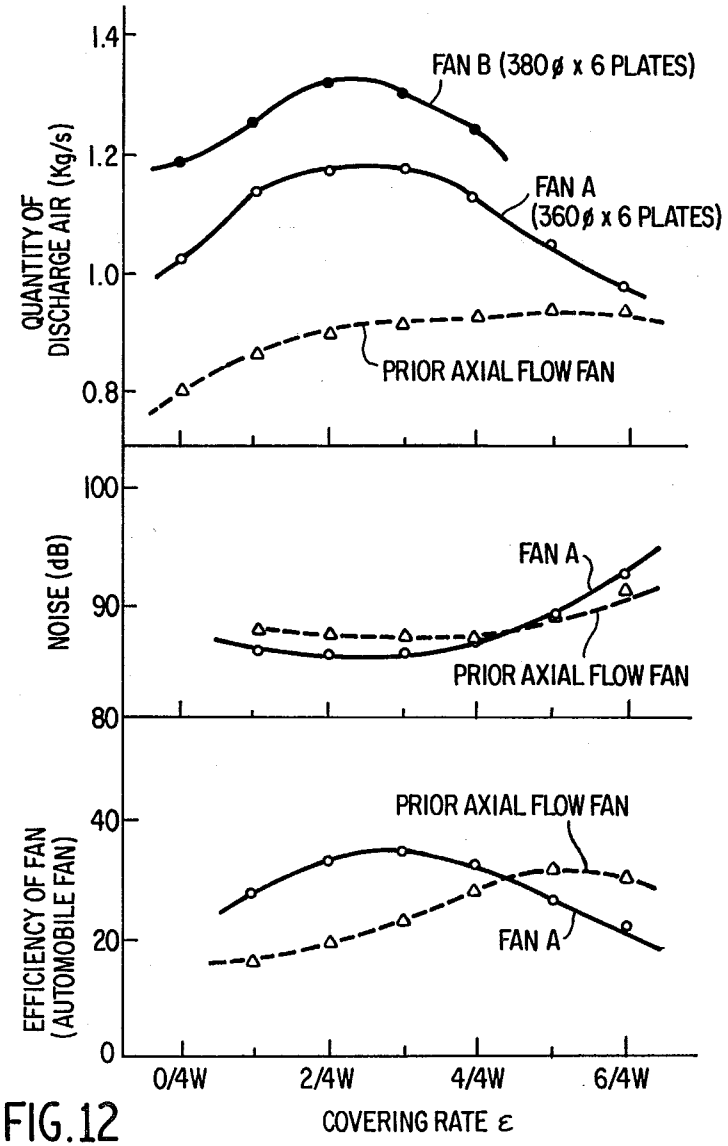
FIG. 12 illustrates plots showing the characteristics of an axial flow fan according to the present invention.

The description will now turn to the test results of the axial flow fan according to the present invention. The fan and shroud are used in the tests are as follows:

In the tests, the covering rate (inserted length) of the shroud relative to the fan is varied, with the covering rate in the third embodiment being taken as a reference value, for investigating the characteristics of the fan. The tests will be described with reference to Table 1 and FIG. 12.

TABLE 1

| | | | |
|---|---|---|---|
| Fan | Outer diameter × number of blades | A fan | 360 ϕ × 6 blades |
| | | B fan | 380 ϕ × 6 blades |
| | Auxiliary blades: two blades/ per fan blade on suction surface of fan blade | | |
| | Height: 10 mm | | |
| | Attaching angles of auxiliary blades: | outer blade | 12° |
| | | inner blade | 23° |
| | (Angle with respect to the rotational direction) | | |
| Shroud | Inner diameter 420 ϕ (cylinder on the side of fan) | | |

TABLE 1-continued

| | |
|---|---|
| Clearance on one side: | 360 $\phi$ : 30 mm<br>380 $\phi$ : 20 mm |

The test results reveal that the quantity of discharge air is maximized at a covering rate of 2/4 to 3/4. The range of the covering rate for achieving the desired noise level and efficiency, superior to those of the prior art fan, is as follows:

$$\epsilon < 4/4W$$

The inserted length (covering rate) of the axial flow fan having auxiliary blades, according to the invention, relative to the shroud, preferably should be no less than 4/4W (L=4/4W), from the viewpoint of the desired characteristics of the fan.

The present invention, however, is by no means limited to the preceding embodiments and may be varied in various forms.

In other words, the present invention covers the fans having auxiliary blades in which one or more auxiliary blades are formed on one or both surfaces of a fan, i.e., on the suction or pressure side thereof, with the leading end of the auxiliary blade being positioned closer to the center of rotation than the trailing end of the auxiliary blade. In this respect, other shapes and dimensions may be applied to these embodiments, or alterations and modifications may be made, with the same functions and advantages being attained.

Figure 14:
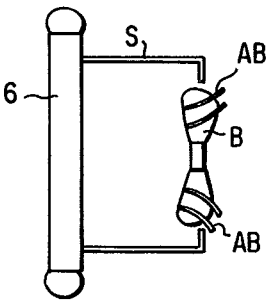
FIGS. 13 to 16 are views illustrative of further embodiments of the invention.
Figure 16:
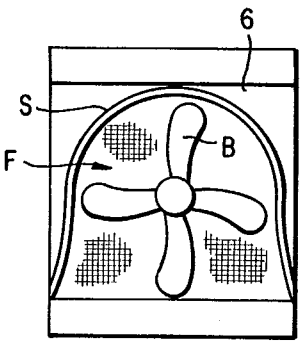
Figure 13:
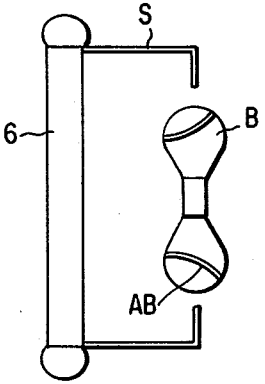
Figure 15:
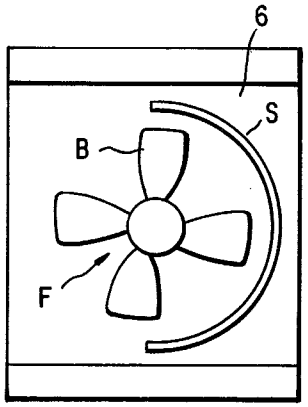

The shape of the shroud shown herein should not necessarily be limited to those given in the embodiments herein. For instance, the shape of the shroud may be modified into a mode shown in FIG. 13, wherein an annular member is provided at one end of a hollow cylindrical body, with the inner diameter of the annular member being larger than the diameter of the fan, a mode shown in FIG. 14, wherein there is provided a cylindrical shroud having a given diameter relative to the diameter of the fan (no restricted portion), or a mode shown in FIGS. 15 and 16, wherein a shroud is composed of a half of a hollow cylindrical body.

These modified shrouds may afford functions and advantages similar to those of the embodiments shown herein.

The arrangement of the shroud and the fan may be varied, other than those shown in embodiments given herein, as far as the aforesaid arrangement meets the relationship of $L \leqq W$ (L represents the length of a fan blade relative to a shroud).

In short, the inserted length of the fan relative to the shroud should meet the following relationship in axial flow fans according to the present invention: $0 \leqq L \leqq W$. Then a circulating flow or a reverse flow flowing through a clearance defined between the shroud and the fan may be prevented by the shroud and centrifugal air streams created by the auxiliary blades, so that the fan may introudce an increased quantity of air, as compared with the prior art fan, and thus discharge strong air streams, including axial air streams and centrifugal air streams.

While the present invention has been described herein with reference to certain exemplary embodiments thereof, it should be understood that various changes, modifications, and alterations may be effected without departing from the spirit and the scope of the present invention, as defined in the claims.

What is claimed as new and desired to be secured by Letters Patent of the United States is:

1. An axial flow fan having auxiliary blades comprising:

a hub member rotatably supported and driven by a drive source;

a plurality of main blades having a predetermined angle with respect to the rotational direction thereof and a predetermined width and height, said blades being radially provided on said hub member;

at least one auxiliary blade formed on at least one of a suction surface and a pressure surface of each of said main fan blades and having a predetermined length in a width of said main fan blades, a leading edge of each of said auxiliary blades being positioned closer to the axis of rotation of the respective one of said main fan blades than a trailing edge thereof; and a shroud comprising a thin hollow member having a large opening and a small throttled opening at opposite ends thereof, said fan blade being inserted within said shroud from said small throttled opening toward said large opening of said shroud, and an axial inserted width L of said main fan blade, which is defined by a point of minimum opening of said small throttled opening and an inserted end portion of said inserted fan blade in the axial direction, and an axial entire width W of said fan blade being maintained in the following relation $$0 \leqq L \leqq W.$$

2. An axial flow fan having auxiliary blades according to claim 1, wherein:

said axial inserted width L and said axial entire width W of said fan blade are maintained in the following relation $$1/4W \leqq L \leqq 4/4W.$$

3. An axial flow fan having auxiliary blades according to claim 1, wherein said axial inserted width L and said axial entire width W of said fan blade are maintained in the following relation $$2/4W \leqq L \leqq 3/4W.$$

4. An axial flow fan having auxiliary blades according to claim 1, wherein said axial inserted width L and said axial entire width W of said fan blade are maintained in the following relation $$L = 2/4W.$$

5. An axial flow fan having auxiliary blades according to claim 1, wherein at least two auxiliary blades are provided on each of said plurality of main blades.

6. An axial flow fan having auxiliary blades according to claim 1, wherein each of said auxiliary blades is positioned in the radially outermost portion of the respective one of said main fan blades.

7. An axial flow fan having auxiliary blades according to claim 1, wherein each of said auxiliary blades is inclined radially outwardly at predetermined angles with respect to the surface of the respective one of said main fan blades, thereby smoothly producing a radial flow by said inclined auxiliary blades.

8. An axial flow fan having auxiliary blades according to claim 1, wherein each of said auxiliary blades is disposed extending beyond an end portion of a trailing edge of the respective one of said main fan blades, thereby increasing a radial flow by said extending part of said auxiliary blades.

9. An axial flow fan having auxiliary blades according to claim 5, wherein said auxiliary blades on each of said main blades are respectively provided in parallel.

10. An axial flow fan having auxiliary blades according to claim 5, wherein the distance between said two adjacent auxiliary blades at said leading edges thereof in the radial direction of said main blade is larger than that at said trailing edges thereof, thereby increasing a radial flow by said auxiliary blades.

11. An axial flow fan having auxiliary blades according to claim 5, wherein said auxiliary blades are provided on at least one surface selected from the group consisting of only a suction surface of said main fan blades, only a pressure surface of said fan blades, and both of the suction and pressure surfaces of said blades.

12. An axial flow fan having auxiliary blades according to claim 1, wherein one auxiliary blade is respectively provided on each of the suction surfaces of four blades, and said axial inserted width L is 0.

13. An axial flow fan having auxiliary blades according to claim 12, wherein said axial flow fan is an electric motor fan which is applied to a ventilation fan having four circular blades, a frame fixed to a wall and supporting an electric motor by four leg members, a shroud having said small throttled opening opposite to a trailing edge of said main fan blade and said large opening fixed to said frame, and strip and rotatable members are parallely provided at said large opening of said shroud.

14. An axial flow fan having auxiliary blades according to claim 12, wherein said axial flow fan is an electric motor fan which is applied to a ventilation fan having four circular blades, a frame fixed to a wall and supporting an electric motor by four leg members, a shroud having said small throttled opening opposite to a leading edge of said main fan blade and said large opening fixed to said frame, and strip and rotatable members provided in parallel at a rear part of said frame.

15. An axial flow fan having an auxiliary blade according to claim 10, wherein two auxiliary blades are respectively formed on each of the suction surfaces of four main blades, said axial inserted width L and said axial entire width W of said fan blade are maintained in the following relation $$L=3/4W,$$

and said auxiliary blade is disposed extending beyond an end portion of said trailing edge of said fan blade, the length of said extended portion of said auxiliary blade being 1/5 of the width of said fan blade.

16. An axial flow fan having auxiliary blades according to claim 15, wherein said fan blades are driven by a drive means through a rotary shaft forming said hub member, said fan blades are provided at a connecting part of an opening formed at a wall of a building and said small throttled opening of said shroud is fixed to said wall, and said large opening of said shroud is opposite of a device generating heat.

17. An axial flow fan having auxiliary blades according to claim 10, wherein two auxiliary blades are respectively formed on each of the suction surfaces of six blades, said auxiliary blades are inclined radially outwardly at predetermined angles with respect to said suction surfaces of said fan blades, and said axial inserted width L and said axial entire width W of said fan blade are maintained in the following relation $$L=2/4W.$$

18. An axial flow fan having auxiliary blades according to claim 17, wherein said axial flow fan is applied to a radiator fan which is provided between a radiator and an engine driving said radiator fan and which is surrounded by said small throttled opening of said shroud fixed to said radiator with a large part forming said large opening, and the height of said auxiliary blade is gradually increased from said leading edge to said trailing edge thereof, an approaching angle of said upper auxiliary blade to the direction of the rotation of said fan blade being 12° and an approaching angle of said lower auxiliary blade to that being 23°.

19. An axial flow fan having auxiliary blades, according to claim 9, wherein three auxiliary blades are respectively formed on each of the suction surfaces of six blades, and said axial inserted width L and said axial entire width W of said fan blades are maintained in the following relation $$L=2/5W.$$

20. An axial flow fan having auxiliary blades according to claim 19, wherein said axial flow fan is applied to a radiator fan which is provided between a radiator and an engine driving said radiator fan which is surrounded by said small throttled opening having an enlarged opening part of said shroud fixed to said radiator with a large part forming said large opening.

21. An axial flow fan having auxiliary blades according to claim 9, wherein two auxiliary blades are respectively formed on each of the pressure surfaces of six blades, and said axial inserted width L and said axial entire width W of said fan blade are maintained in the following relation $L=3/4W.$

22. An axial flow fan having auxiliary blades according to claim 21, wherein said axial flow fan is applied to a radiator fan in a fork lift, which is provided between a radiator and an engine which is provided in front of said fan blade and is driving said radiator fan through a shaft connected to said hub member, said radiator being provided adjacent to discharge holes provided at a rear part of a body of said fork lift, and said axial flow fan is provided at said small throttled opening having a short and enlarged opening of said shroud which is fixed to said radiator at said large opening.

* * * * *